US005774050A

United States Patent [19]

Kägi

[11] Patent Number: 5,774,050

[45] Date of Patent: Jun. 30, 1998

[54] RADIO ALARM SECURITY SYSTEM

[75] Inventor: René Kägi, Stäfa, Switzerland

[73] Assignee: Baumer Holding AG, Frauenfeld, Switzerland

[21] Appl. No.: 401,620

[22] Filed: Mar. 9, 1995

[30] Foreign Application Priority Data

Mar. 24, 1994 [CH] Switzerland ..... 00881/94

[51] Int. Cl.[6] ..... G08B 1/08

[52] U.S. Cl. ..... 340/539; 340/531; 340/693

[58] Field of Search ..... 340/539, 531, 340/526, 527, 693; 341/176

[56] References Cited

U.S. PATENT DOCUMENTS

| | | | |
|---|---|---|---|
| 3,833,895 | 9/1974 | Fecteau | 340/539 |
| 4,157,540 | 6/1979 | Oros | 340/527 |
| 4,257,038 | 3/1981 | Rounds et al. | 340/539 |
| 4,442,426 | 4/1984 | Heuschmann et al. | 340/539 |
| 4,446,454 | 5/1984 | Pyle | 340/531 |
| 4,833,449 | 5/1989 | Gaffigan | 340/539 |
| 4,906,972 | 3/1990 | Spencer | 340/539 |
| 5,257,007 | 10/1993 | Steil et al. | 340/539 |
| 5,365,217 | 11/1994 | Toner | 340/531 |

FOREIGN PATENT DOCUMENTS

| | | |
|---|---|---|
| 0 022 026 | 1/1981 | European Pat. Off. . |
| 0 391 566 | 10/1990 | European Pat. Off. . |
| 2 708 774 | 2/1995 | France . |
| 94/03881 | 2/1994 | WIPO . |

*Primary Examiner*—Donnie L. Crosland
*Attorney, Agent, or Firm*—Spencer & Frank

[57] ABSTRACT

The radio alarm security system, particularly for the protection of persons within a building against intruders, includes a mobile central alarm unit which is provided with a separate power source and is temporarily connectable to at least one charging station, and includes a receiver unit for the radio signals of alarm indicators, with a transmitter unit for producing radio signals for activating alarm generators as well as with an optical and acoustic display device for the received radio signals and at least hand-activatable initiating device for the radio signals activating the alarm generators.

5 Claims, 3 Drawing Sheets

RADIO ALARM SECURITY SYSTEM

BACKGROUND OF THE INVENTION

The present invention relates to a radio alarm security system, particularly for the protection of persons within a building against intruders.

The need for burglary and robbery alarm systems is high. Accordingly, numerous wire-based and radio-controlled systems are commercially available on the market.

The disadvantage in such security systems is the necessarily stationary control centre of the respective system, in which the entire information has to be obtained. This requires that the operator go to the site of the control center in the event of an alarm. Moreover, such systems demand the switch-off of the security zones during the presence of the operator in order to exclude false alarms. In order to prevent this the alarm system remains switched off during the operator's presence.

SUMMARY OF THE INVENTION

It is therefore the object of the present invention to provide a radio alarm security system which is permanently active during the presence of persons, which functions free from any false alarms without any limitations to the daily routine, which excludes daily manipulations to the central control and which allows the operator to obtain precise information everywhere in the building on the conditions of the security zones.

This is achieved in accordance with the invention by a mobile central alarm unit which is provided with a separate power source and is temporarily connectable to at least one charging station and comprises a receiver unit for the radio signals of alarm indicators, a transmitter unit for producing radio signals for activating alarm generators as well as optical and acoustic display means for the received radio signals and at least hand-activatable initiating means for the radio signals activating the alarm generators.

As a result of the measures in accordance with the invention, it is now possible to initiate all alarms via radio, optically and acoustically visible in the mobile central alarm unit, which silent initiation of alarm grants the operator the possibility to decide whether or not to initiate a hand-activatable alarm.

It is thus also possible to keep the security system in accordance with the invention permanently active and, in addition, to use it as a monitoring system for the movements of children and pets, for example, within the monitored zones.

In order to initiate, on the one hand, the alarm by hand and to prevent, on the other hand, inadvertent contact with the activation keys, it is further provided in accordance with the invention that the mobile central alarm unit is provided on the transmitter side with a hand-operated key for an initiation of the alarm of the interior/exterior alarm detectors, a time-delay stage which prevents an initiation of the external alarm by inadvertent short-term pressing of the two alarm buttons as well as a timer which switches on the alarm transmission unit for a defined period of time. In outgoing circuit from these an encoder stage is connected which produces several serial data messages.

In order to decipher all data messages, e.g. from the alarm indicators, from the monitoring stage concerning the charging condition of the batteries and the like, it is advantageous when decoders for the receipt of data messages are connected in incoming circuit before the receiver unit of the central alarm unit.

In order to determine the function and any malfunctions in the central alarm unit or the security system such as disturbed radio links by external influences, site of receiver outside of transmitter range, defective test oscillator or defective receiver, etc., it is advantageous that a test oscillator is integrated with a timer for initiating successive test messages in intervals, with an encoder producing several serial data messages.

BRIEF DESCRIPTION OF THE DRAWINGS

An exemplary embodiment of the subject matter of the invention is explained below in closer detail by reference to the enclosed drawings; in which.

DETAILED DESCRIPTION OF THE PREFERRED EMBODIMENTS

Figure 1:
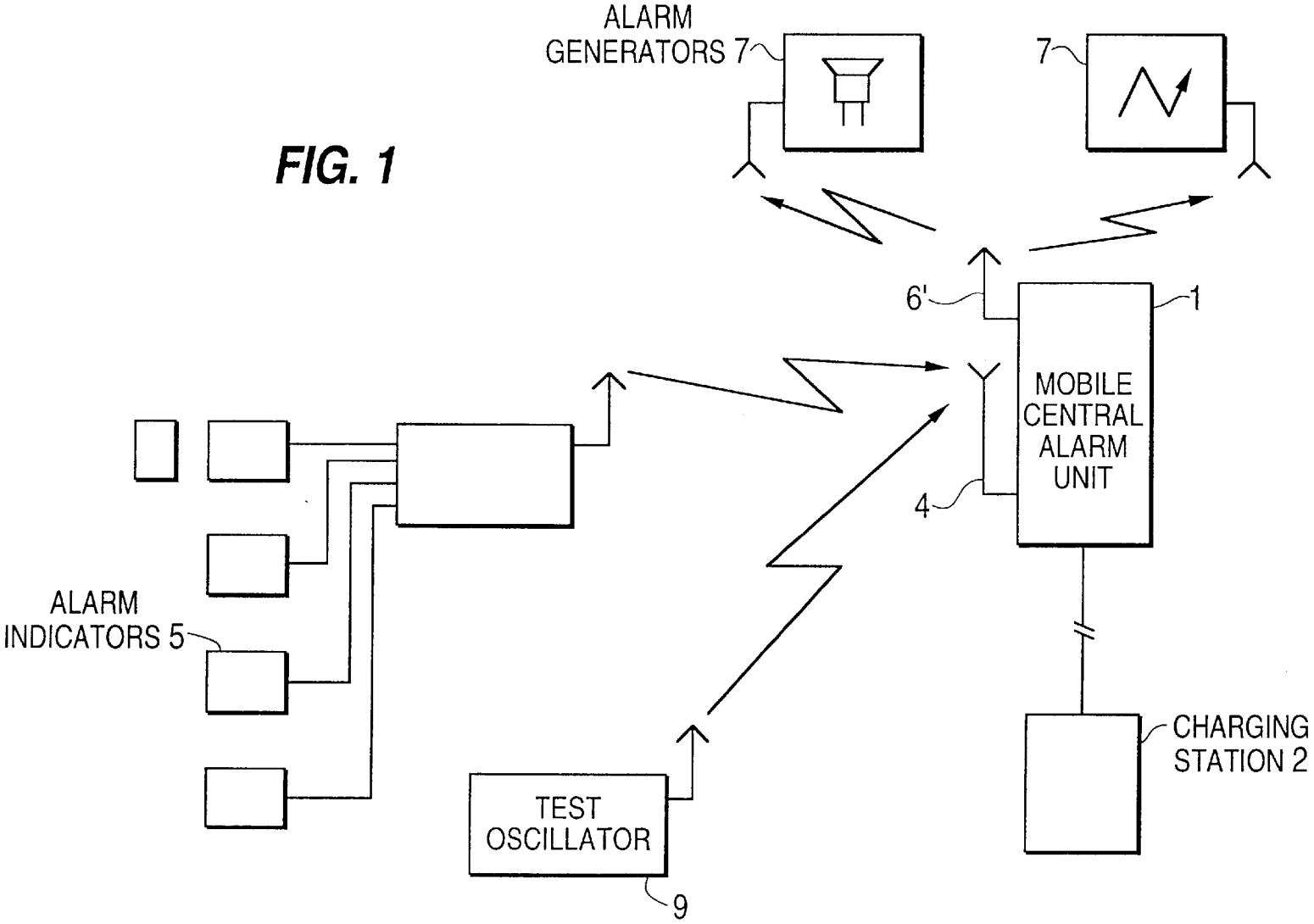
FIG. 1 shows in a block circuit diagram the overall arrangement of the radio alarm security system.

The radio alarm security system in accordance with FIG. 1 comprises a mobile central alarm unit 1 which is provided with a separate power source 3 (FIG. 2) and is temporarily connectable to at least one charging station on 2, and comprises a receiver unit 4 for the radio signals of alarm indicators 5 and with a special part 6 for producing radio signals for activating the alarm generators 7. As will be explained below in closer detail by reference to FIG. 2, the mobile central alarm unit is also provided, in accordance with the invention, with optical and acoustic display means in order to display in silent alarm the radio signals received from alarm indicators 5. Furthermore, hand-activatable initiating means are provided in accordance with the invention in order to initiate the radio signals required for the activation of alarm generators 7.

Figure 2:
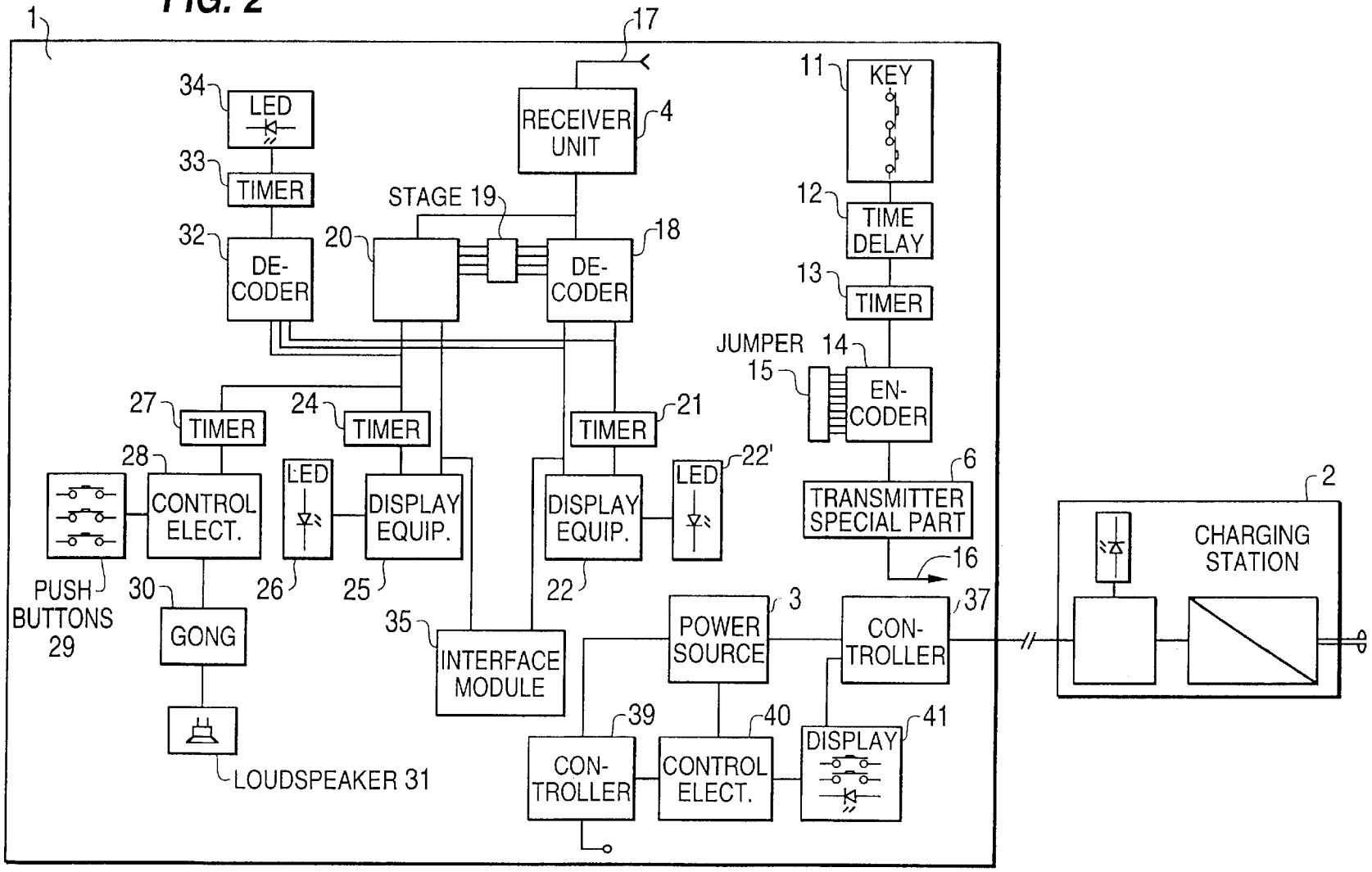
FIG. 2 shows the mobile central alarm unit in a block circuit diagram of the system in accordance with FIG. 1.

It is favourable in this respect if charging stations 2 are provided in the system and at different sites in order to allow the central alarm unit 1 to be charged, as far as possible, in the ultimate vicinity of the respective site of the operator. As is shown in FIG. 2 in closer detail, the mobile central alarm unit 1 comprises a hand-operated key 11 for an initiation of alarm of the inner/outer alarm generators 7, a time-delay stage 12 which prevents an initiation of the external alarm by inadvertent short-time pressing of the two alarm keys 11, as well as a timer 13 which switches on the alarm transmission unit for a defined period of time.

Furthermore, an encoder stage 14 is connected in outgoing circuit, which stage produces several serial data messages and which comprises insertable wire jumpers 15 for setting the data code which must coincide with those of the alarm detectors for setting the code.

The transmitter unit 6 with its antennae 6' is connected in outgoing circuit to the arrangement.

The receiver unit 4 comprises the receiver with its antennae 17, with the decoder 18 being connected in incoming circuit for the data messages of the charging condition of battery power source 3. The signals received are compared in the decoder with the set system code. In the event of congruence of two received data messages with the set code the signal "DATA TRUE" is output. Simultaneously, the alarm address is output as BCD code. The setting of the system code is made via stage 19, whereby the code must be identical with the set code of alarm indicator 5. Furthermore, "alarm" is provided for data messages which compares the received signals with the set system code. In the event of congruence of two received data messages with the set code, the signal "DATA TRUE" is output. The alarm address is output simultaneously as BCD code. A timer 21 will control the respective LED 22' to burn for approx. 12 minutes. Furthermore, electronic display equipment 22 is provided too.

A further timer 24 controls the respective LED 26 for alarm display to burn over a period of approx. 6 minutes, to which electronic display equipment 25 is allocated.

A further timer 27 controls the acoustic signal transmitter via control electronics 28 which store the desired signal volume which can be entered via the pushbuttons 29. A function module with 3-sound gong 30 and a loudspeaker 31 are connected in outgoing circuit thereto.

As was mentioned above, the mobile central alarm unit 1 is connectable to a charging station which is usually one that is commonly available. For this purpose the central alarm unit comprises a common chargeable battery 3, to which a rapid charge controller 37 is connected in incoming circuit, for which purpose an on-off controller 39 is provided for the power supply and control electronics 40 for switching the device on/off and for battery voltage monitoring. The functions are clearly indicated via LED displays 41.

The alarm indicators cooperating with the mobile central alarm unit may be magnetic contact detectors, broken-glass detectors, passive infrared motion detectors and the like of common design.

Figure 3:
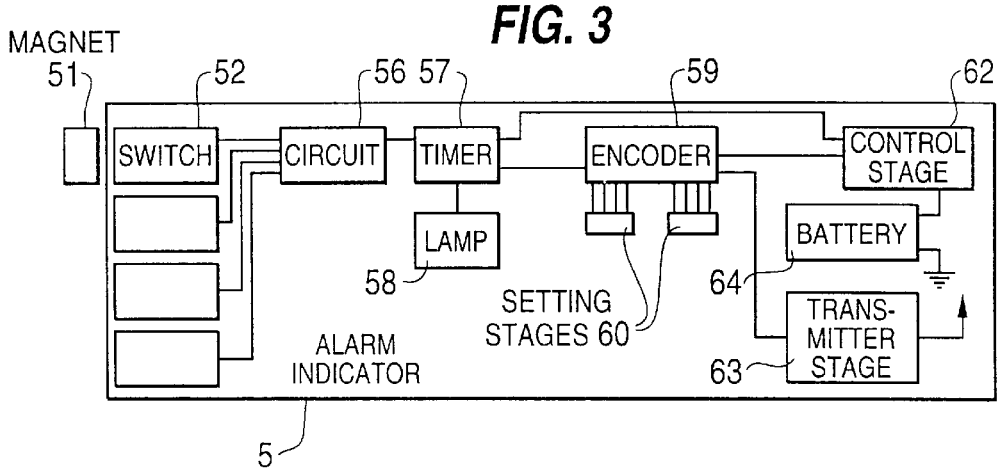
FIG. 3 shows an embodiment of alarm indicators in a block circuit diagram for the system in accordance with FIG. 1.

The alarm indicator 5 shown herein comprises in accordance with FIG. 3 door or window magnets 51 which each cooperate with an allocated magnetic switch 52. The initiation of the alarm is made by the removal of the permanent magnet 51, whereas the contact is closed in the idle position. An electronic circuit 56 is connected in outgoing circuit to the magnetic switches 52 for monitoring the contact, whereby a timer 57 switches on the alarm transmission unit for a defined period of time. During the transmission of the alarm a control lamp 58 may burn.

Moreover, an encoder 59 produces via setting stages 60 several data messages to the transmitter stage 63.

Battery 64 is commercially available and its charging condition is monitored via the control stage 62. The battery voltage is measured during the data transmission (battery is under load). If the measured voltage is below a defined value, the timer is started again following the transmission of the alarm. Further data messages are generated. The code is thus automatically changed in encoder 59.

Figure 4:
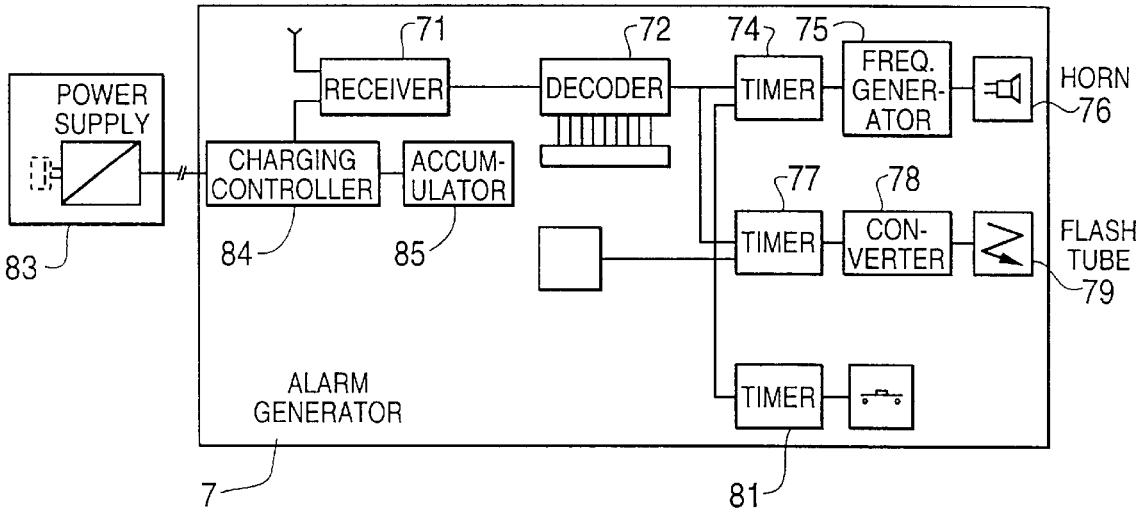
FIG. 4 shows an embodiment of alarm detectors in a block circuit diagram for the system in accordance with FIG. 1

The alarm generators 7—as shown in FIG. 4—of the security system in accordance with FIG. 1 comprises a receiver 71 with antennae which cooperates with a decoder 72 connected in outgoing circuit. The decoder 72 compares the signals received with the set code. In the event of congruity of two received data messages with the set code, the signal "DATA TRUE" is generated. A timer 74 switches the acoustic alarm on for 3 minutes, whereby a piezoelectric horn 76 is activated via a frequency generator 75, whereas a timer 77 will switch on the optical alarm for 10 minutes via a high-voltage converter 78 and a flash tube 79. A further timer 81 switches on the timers 74 and 77 for a period of three minutes to 1/124th of the normal switch-on period in order to allow a function test to be carried out.

Alarm generator 7 may be provided with an accumulator 85 which can be connected to a power supply unit 83 via a charging controller 84.

Figure 5:
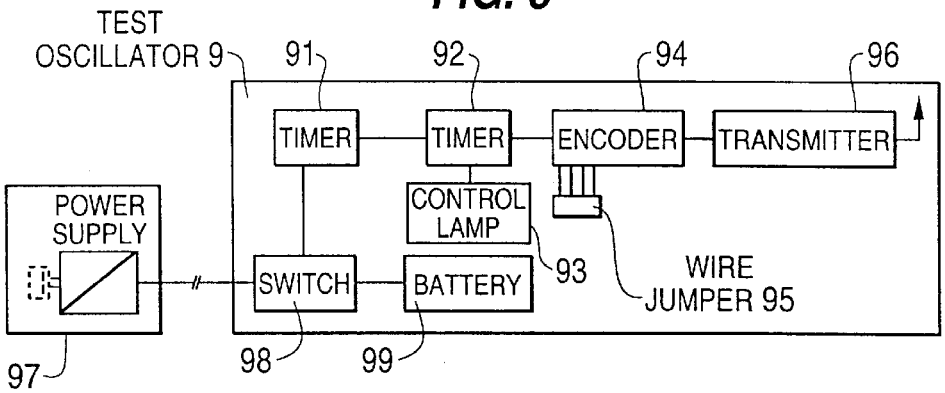
FIG. 5 shows a test oscillator in a block circuit diagram as an integrated component of the central alarm unit of the system in accordance with FIG. 1.

In order to be able to determine the function and any malfunctions in the central alarm unit 1 or the security system, respectively, such as disturbed radio links by external influences, site of receiver outside of transmitter range, defective test oscillator or defective receiver, a test oscillator 9 is integrated in the radio alarm security system which comprises in accordance with FIG. 5 a timer 91 which issues a test message in intervals of 5 minutes. A further timer 92 switches on the data transmission unit for a defined period of time. For this purpose a control lamp 93 will burn during the data transmission, which after the removal of the insertable wire jumper 95 can be switched off permanently. An encoder 94 will produce several serial data messages which the transmitter 96 with antennae transmits to the central alarm unit 1. A power supply unit 97 in a separate casing is used for supplying the test oscillator with power via an emergency power supply switch 98 and a battery 99.

For the receipt and evaluation of the data messages of the test oscillator 9 the central alarm unit 1 in accordance with FIG. 2 further comprises a decoder 32 which evaluates the test message signals such as test messages received correctly, alarm data messages received correctly or battery low data message received correctly.

If one of these parameters is fulfilled, a timer 33 is reset. This timer is used for checking the incoming data messages. If the timer does not receive any signals from the test decoder over a period of 12 minutes, an LED 34 is activated. It has to be assumed that one of the following faults has occurred, namely the radio link has been disturbed by external influences or the receiver is outside of the transmitter range or the test oscillator is defective or the receiver is defective.

As an expansion it is possible to further provide an interface module 35 with an add-on circuit board which contains a serial interface for data transmission to a central unit for protection during absence.

The above-mentioned alarm system therefore offers the highest convenience and does not require any extensive instructions. The central alarm unit can not only receive incoming messages, but can also transmit alarm signals. It can be installed easily by oneself, as the installation is limited purely to window and door sensors. Even initiated alarms are recorded by the mobile central unit discreetly.

The operator himself can decide when the sirens or an alarm by telephone should be initiated.

The radio alarm security system is particularly location-independent and can be placed anywhere in the house and thus offers the substantial advantage over common alarm systems that it can react quicker and securer in the event of an alarm.

Furthermore, the radio alarm security system in accordance with the invention can be programmed in many ways, it is provided with a large number of independent alarm lines over which the condition of the batteries is also monitored continuously.

While there are shown and described preferred embodiments of the invention, it is to be distinctly understood that the invention is not limited thereto but may be embodied and practised within the scope of the following claims. ACCORDINGLY;

What I claim is:

1. A radio alarm security system, comprising:

a portable central alarm unit, including:

a separate, rechargeable power source temporarily connectable to at least one charging station for charging the power source;

a receiving assembly, including:

a receiver unit for receiving radio signals generated from alarm indicators indicating an alarm condition; and optical and acoustic display means connected with said receiver unit and being activatable as a result of the radio signals for alerting a user of the alarm condition; and a transmitting assembly, including:

a hand-activatable initiating means for initiating additional radio signals; and a transmitter unit connected with said initiating means for transmitting the additional radio signals to activate an alarm generator.

2. The radio alarm security system defined in claim 1, wherein said system protects persons within a building against intruders.

3. The radio alarm security system defined in claim 1, wherein said initiating means comprises a hand-operated key being operatable for initiating the additional radio signals to activate the alarm generators, said transmitting assembly further comprising a time-delay stage electrically connected to said key to prevent an initiation of the alarm generator due to an inadvertent quick pressing of said key, a timer electrically connected with said time-delay stage and said transmitter unit for switching on said transmitter unit for a defined period of time, and an encoder stage electrically connected downstream to said timer for producing a plurality of data messages.

4. A The radio alarm security system defined in claim 1, wherein said receiving assembly includes a plurality of decoders electrically connected with said receiver unit for receiving data messages.

5. The radio alarm security system defined in claim 1, further comprising a test oscillator having a timer and encoder for initiating and transmitting to said portable central alarm unit in intervals a plurality of serial test messages.

* * * * *